US005613477A

United States Patent [19]

Maeda

[11] Patent Number: 5,613,477

[45] Date of Patent: Mar. 25, 1997

[54] EVAPORATIVE FUEL TREATMENT DEVICE

[75] Inventor: Kazuto Maeda, Nisshin, Japan

[73] Assignee: Nippondenso Co., Ltd., Kariya, Japan

[21] Appl. No.: 642,422

[22] Filed: May 3, 1996

[30] Foreign Application Priority Data

May 8, 1995 [JP] Japan ..... 7-109300
Jan. 16, 1996 [JP] Japan ..... 8-004799

[51] Int. Cl.[6] ..... F02M 33/04
[52] U.S. Cl. ..... 123/519
[58] Field of Search ..... 123/516, 518, 123/519, 520

[56] References Cited

U.S. PATENT DOCUMENTS 4,658,796 4/1987 Yoshida et al. ..... 123/516
5,143,035 9/1992 Kayanuma .
5,355,861 10/1994 Arai ..... 123/519
5,361,743 11/1994 Denz et al. ..... 123/519
5,373,830 12/1994 Denz et al. ..... 123/519
5,419,299 5/1995 Fukasawa et al. .
5,450,833 9/1995 Denz et al. ..... 123/520
5,501,198 3/1996 Koyama ..... 123/520

*Primary Examiner*—Thomas N. Moulis
*Attorney, Agent, or Firm*—Cushman, Darby & Cushman IP Group of Pillsbury Madison & Sutro LLP

[57] ABSTRACT

According to the present invention, an evaporative fuel absorbing chamber absorbingly treating evaporative fuel, a second atmospheric chamber communicating with the evaporative fuel absorbing chamber, and a first atmospheric chamber separated from the second atmospheric chamber with a partition wall are formed in a case. An upper cover for forming the upper wall of the first atmospheric chamber has a cylindrical convex portion extending inside the first atmospheric chamber. When the upper cover is fixed after inserting the bottom end of an eletromagnetic valve into a communicating hole of the partition wall, the top end of the electromagnetic valve is fastened to the cylindrical convex portion. Thus, the electromagnetic valve is prevented from being clattered, and air leakage from between the communicating hole and the electromagnetic valve can be reduced. An air passage from the electromagnetic valve to the evaporative fuel absorbing chamber is formed in the canister, so that the evaporative fuel can be prevented from leaking from the gas passage.

20 Claims, 4 Drawing Sheets

EVAPORATIVE FUEL TREATMENT DEVICE

CROSS REFERENCE TO RELATED APPLICATION

This application is based upon and claims priority of Japanese Patent Application Nos. Hei. 7-109300 filed on May 8, 1995 and Hei. 8-4799 filed on Jan. 16, 1996, the content of which are incorporated herein by reference.

BACKGROUND OF THE INVENTION

1. Field of the Invention

The present invention relates to an evaporative fuel treatment device for absorbing evaporative fuel from a fuel tank of a vehicle and to prevent the evaporative fuel from being released to the atmosphere.

2. Description of Related Art

Conventionally, it has been well-known that the evaporation amount of evaporative fuel from fuel systems such as a fuel tank and a carburetor increases with the increase of temperature. Immediately after a vehicle stops, the temperature inside the fuel tank is especially high due to active evaporation of the fuel, which requires an evaporative fuel treatment device having a function to accumulate the evaporative fuel temporarily.

An evaporative fuel treatment device including an evaporative fuel absorber filled with activated charcoal disposed between the fuel tank and the intake pipe connected to the engine has been widely known and accumulates the evaporative fuel temporarily by the evaporative fuel absorber when the engine stop. The evaporative fuel treatment device takes in the air from the outside of the evaporative fuel absorber, and the evaporative fuel caught by the activated charcoal is purged to purify the activated charcoal by absorbing the evaporative fuel into the intake pipe side. The evaporative fuel absorber is equipped with an electromagnetic valve to connect or interrupt the connection between the inside and the outside of the evaporative fuel absorber. The electromagnetic valve is normally open, but is closed to accumulate negative pressure therein when leakage is checked in the evaporation system. Leakage of the evaporative fuel is judged by monitoring the negative pressure value.

As one of such evaporative fuel treatment devices, an evaporative fuel gas diffusion prevention device disclosed in JP-A-6-159160 has been proposed.

However, according to the above-described conventional evaporative fuel treatment device, since a hose is used to connect the electromagnetic valve and the evaporative fuel absorber, there is a problem in that absorbed evaporative fuel is apt to leak from the hose. An evaporative fuel absorber connected directly to the electromagnetic valve is also known, where one end of the electromagnetic valve is inserted into a case of the evaporative fuel absorber and a fixing stay of the electromagnetic valve is screwed to the case of the evaporative fuel absorber with bolts or the like. However, when an external pressure is applied to the electromagnetic valve in this evaporative fuel absorber, the electromagnetic valve is shifted from a predetermined position, which may cause leakage of the evaporative fuel from the portion connecting the evaporative fuel absorber to the electromagnetic valve.

When the air is supplied to the evaporative fuel absorber after being filtrated by a filter disposed inside the electromagnetic valve, dust from the outside may clog up the filter. Furthermore, water entering the electromagnetic valve from the outside may rust the valve body, which causes malfunction of the electromagnetic valve, or may clog up the filter.

SUMMARY OF THE INVENTION

The present invention has an object to provide an evaporative fuel treatment device which prevents leakage of the evaporative fuel from the portion connecting the electromagnetic valve to the evaporative fuel absorber.

Another object of the present invention is to provide an evaporative fuel treatment device having a water-and-dust proof electromagnetic valve.

According to an evaporative fuel treatment device of the present invention, since an electromagnetic valve is firmly positioned in a case with a fastening portion of a cover when the cover is fixed to a case, the electromagnetic is prevented from being shifted. Moreover, evaporative fuel can be prevented from leaking from the portion connecting the electromagnetic valve to the case. Since the electromagnetic valve is contained in a receiving chamber, a portion from an air inlet to a first opening portion can be protected from water. Thus, water can be surely prevented from entering the electromagnetic valve.

Since the fastening portion of the cover may be formed in a convex shape, the convex portion can be engaged with the first opening portion by simply pressing the cover.

Since the receiving chamber may be formed by a wall formed integrally with the case so as to surround the electromagnetic valve and a cover for covering the opening portion of the wall, the receiving chamber can be easily formed by fixing the cover to the opening portion after placing the electromagnetic valve through the opening.

Since the air inlet may be formed at the communicating side of the wall, the air circulates from the air inlet to the fastening portion and flows into the electromagnetic valve through the first opening, which can effectively prevent water from entering the electromagnetic valve.

Since the first opening portion and a second opening portion may be placed face to face on the electromagnetic valve, the air can be efficiently circulated from the first opening portion to the second opening portion.

The electromagnetic valve may be so firmly supported and fixed between the case and the cover that the electromagnetic valve is prevented from being displaced and clattered. The evaporative fuel can be also prevented from leaking from the portion connecting the electromagnetic valve to the case.

Since the air inlet and the first opening portion may be away from each other, water cannot easily enter the electromagnetic valve.

A first seal member disposed between a cylindrical portion and the second opening portion can firmly seal between the electromagnetic valve and the case, which can prevent leakage of the evaporative fuel from the portion connecting the electromagnetic valve to the canister.

The filter may be disposed between the air inlet and the first opening portion and filters the air supplied to the electromagnetic valve, which can prevent dust from entering the electromagnetic valve.

The electromagnetic valve may be disposed in a space formed with the case and an upper cover. The first opening portion of the electromagnetic valve is fastened to the convex portion of the upper cover and the second opening portion of the electromagnetic valve is engaged with the fixing portion of a partition wall of the case. Such a structure enables the electromagnetic valve to be supported firmly between the convex portion of the upper cover and the fixing portion of the partition wall of the case. Thus, the electromagnetic valve is not displaced. Evaporative fuel can be prevented from leaking from the portion connecting the electromagnetic valve to the case. In addition, since the second opening of the electromagnetic valve may directly communicate with the evaporative fuel absorber, a hose to connect the electromagnetic valve to the evaporative fuel absorber is not required, which can certainly prevent the evaporative fuel from leaking.

Since the first opening portion may be open to the atmosphere, the air can be introduced therethrough and further supplied to the evaporative fuel absorbing chamber. Therefore, the evaporative fuel in the evaporative fuel absorbing chamber can be sent to the intake pipe.

Since the air may circulate from the side of fixing portion to the side of the convex portion in the case and further flow from the first opening portion to the electromagnetic valve, water cannot easily enter the electromagnetic valve.

Since the filter may be disposed in the case to filter the air supplied to the electromagnetic valve, dust can be prevented from entering the electromagnetic valve.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EMBODIMENTS

The preferred embodiments of the present invention are hereinafter described with reference to the accompanying drawings.

A first embodiment of an evaporative fuel treatment device according to the present invention is hereinafter described with reference to FIGS. 1–4.

Figure 4:
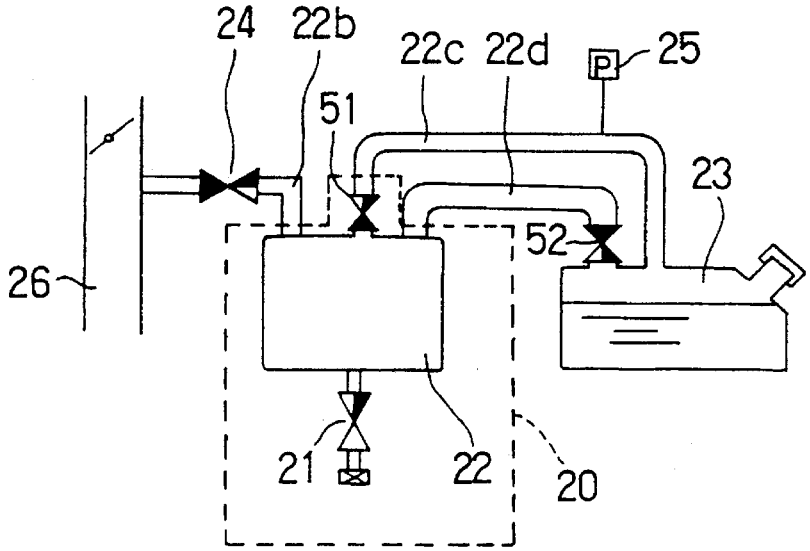
FIG. 4 is a schematic view of a method for treating the evaporative fuel by the evaporative fuel treatment device according to the first embodiment of the present invention.

A method for treating evaporative fuel by the evaporative fuel treatment device is described based on FIG. 4.

A fuel tank 23 is connected to an evaporative fuel absorber 22 through pipes 22*c* and 22*d*. Pipe 22*c* is equipped with a pressure sensor 25 for detecting pressure and an internal pressure control valve 51 for communicating fuel tank 23 with evaporative fuel absorber 22 when the pressure inside fuel tank 23 exceeds a certain value. When the pressure inside fuel tank 23 rises more than a predetermined value by the evaporative fuel generated by the fuel inside fuel tank 23, internal pressure control valve 51 opens to introduce the evaporative fuel to evaporative fuel absorber 22.

Pipe 22*d* having a larger diameter than pipe 22*c* is connected between fuel tank 23 and evaporative fuel absorber 22. An electromagnetic valve 52 is fixed to pipe 22*d*. When oil is supplied to fuel tank 23, electromagnetic valve 52 opens to introduce the evaporative fuel and residual air inside fuel tank 23, which are pushed out by fuel supplied from the oil filler port to evaporative fuel absorber 22 through pipe 22*d*.

Evaporative fuel absorber 22 communicates with one end of an electromagnetic valve 21 and the other end of electromagnetic valve 21 is opened to the atmosphere. When electromagnetic valve 21 is opened, evaporative fuel absorber 22 communicates with the atmosphere. When electromagnetic valve 21 is closed, communication between evaporative fuel absorber 22 and the atmosphere is interrupted. Evaporative fuel absorber 22 also communicates with one end of a purge valve 24. The other end of purge valve 24 communicates with an intake pipe 26. When electromagnetic valve 21 and purge valve 24 are opened, the evaporative fuel absorbed by evaporative fuel absorber 22 is discharged to intake pipe 26.

According to the first embodiment of the present invention, evaporative fuel absorber 22, internal pressure control valve 51 and electromagnetic valve 21 among the above-described components are integrally disposed as a canister assembly 20.

Figure 2:
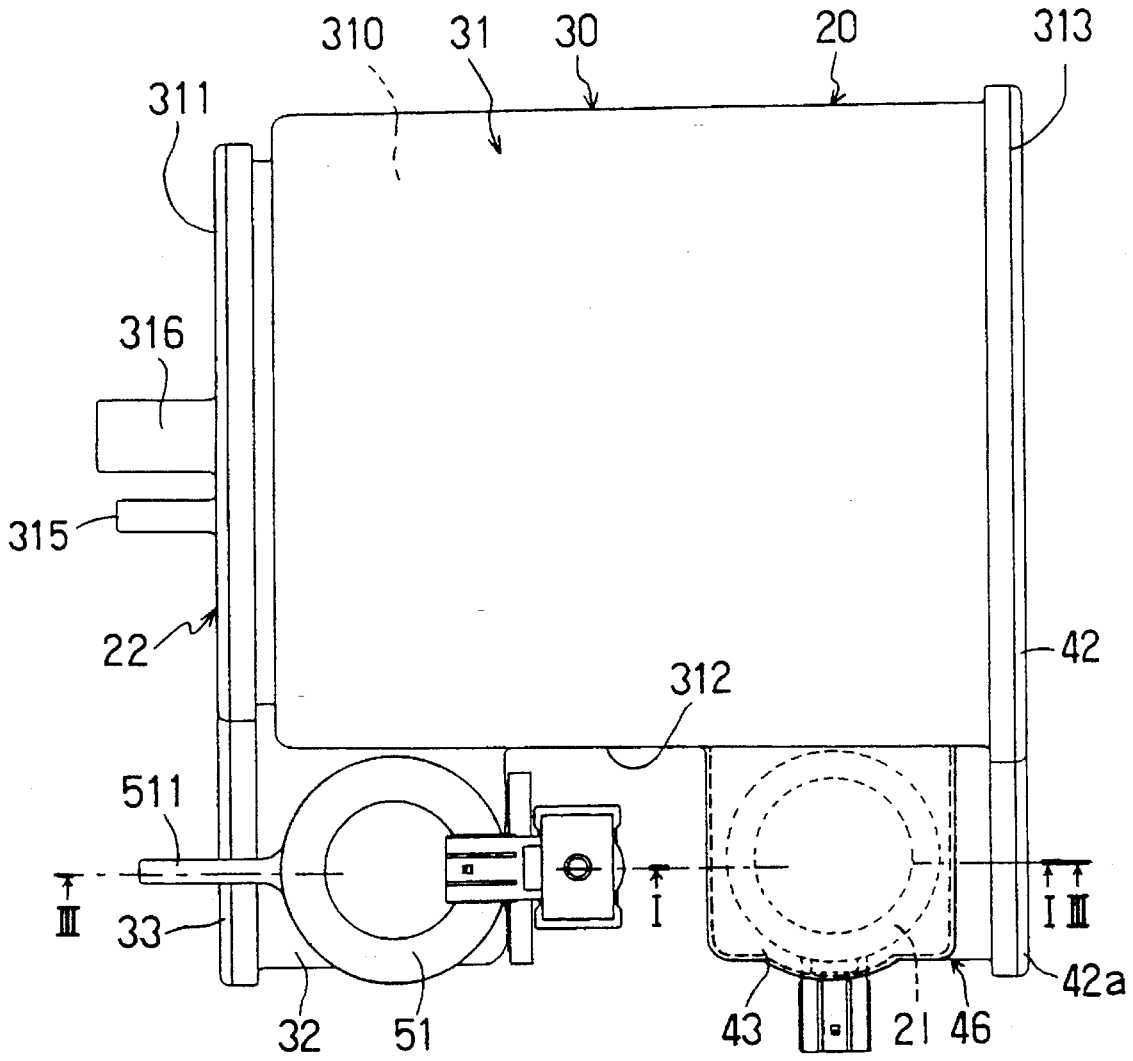
FIG. 2 is a top plan view of the evaporative fuel treatment device according to the first embodiment of the present invention.

As shown in FIG. 2, an activated charcoal case 31 and an electromagnetic valve case 46 sharing a part of wall of activated charcoal case 31 are adjacently disposed in a case (canister) 30 of canister assembly 20. Case 30 is, for example, molded with resin.

Activated charcoal is filled in evaporative fuel absorbing chamber 310 formed inside activated charcoal case 31, thereby composing evaporative fuel absorber 22 to absorb the evaporative fuel. An inlet pipe 315 connected to pipe 22*c* and an outlet pipe 316 connected to pipe 22*b* are disposed on a side 311 of activated charcoal case 31.

Figure 3:
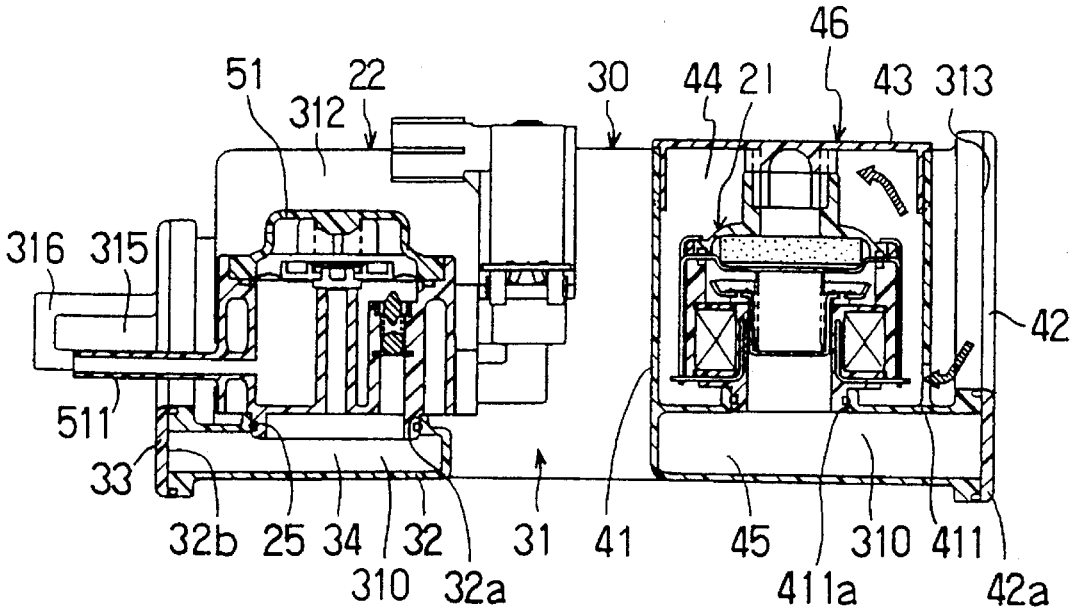
FIG. 3 shows the evaporative fuel treatment device according to the first embodiment of the present invention and is a cross-sectional view taken along line III—III of FIG. 2.

A dividing wall 32 having a squire cross-section without a left vertical line extends perpendicularly to a side 312 from the lower left position of side 312 extending perpendicularly to a side surface 311 as shown in FIG. 3. By fixing a cover member 33 to the left opening 32*b* of dividing wall 32, an inlet chamber 34 communicating with evaporative fuel absorbing chamber 310 is separately formed. An opening portion 32*a* to which internal pressure control valve 51 is fixed is disposed at the top side of dividing wall 32 in FIG. 3. An O-ring 25 air-tightly seals between internal pressure control valve 51 and opening portion 32*a*. An inlet pipe 511 connected to pipe 22*c* connected to fuel tank 23 is disposed at the left side of internal pressure control valve 51 in FIG. 3. When the pressure inside fuel tank 23 exceeds a predetermined value, internal pressure control valve 51 opens to introduce the evaporative fuel from inlet chamber 34 to evaporative fuel absorbing chamber 310.

Electromagnetic valve case 46 includes a dividing wall 41 extending perpendicularly to a side surface 313 from the right side position of side surface 313 in FIG. 3, an upper cover 43 fixed to the upper opening of dividing wall 41, and a side cover 42 fixed to the right side of dividing wall 41.

By fixing side cover 42 to side surface 313 facing side 311 after filling activated charcoal inside the aforementioned activated charcoal case 31, side cover 42 closes side surface 313 of activated charcoal case 31. The lower portion of side cover 42 further extends in the same direction as dividing wall 41. The extending portion 42*a* is mounted on the opening portion disposed at the bottom side of dividing wall 41.

Upper cover 43 has plural snaps 432 extending perpendicularly to a flat plate portion 431 on the outer periphery thereof. The edge of snap 432 is equipped with a hook portion 433 protruding externally therefrom. when snap 432 is placed along the inner side of the upper opening of dividing wall 41 at the time of fixing upper cover 43 to dividing wall 41, hook portion 433 is engaged with a fitting hole disposed inside dividing wall 41. Thus, upper cover 43 is fastened to the top of dividing wall 41.

A cylindrical convex portion 434 as an engaging portion extending in the same direction as snap 432 from the center of flat plate portion 431 is formed on upper cover 43. Cylindrical convex portion 434 has a communicating hole 434*a*, so that cylindrical convex portion 434 is engaged with the top end of electromagnetic valve 21 when upper cover 43 is fixed to the upper opening portion of dividing wall 41. Thus, the top end of electromagnetic valve 21 is fastened to upper cover 43.

Figure 1:
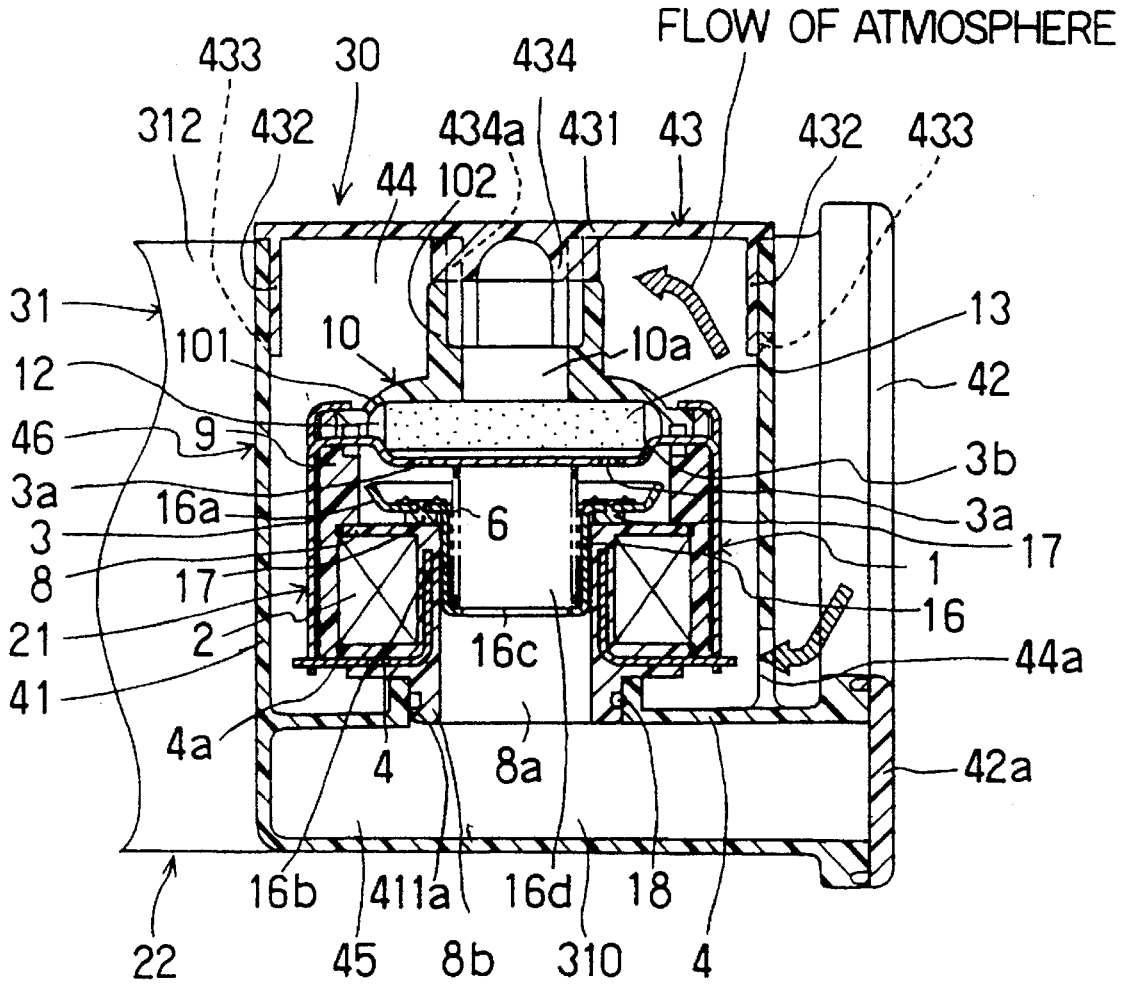
FIG. 1 shows an electromagnetic valve disposed in an evaporative fuel treatment device according to a first embodiment of the present invention and is a cross-sectional view taken along line I—I of FIG. 2.

A partition wall 411 as a part of dividing wall 41 divides the inside of electromagnetic valve case 46 into the first atmospheric chamber 44 located at the upper side and the second atmospheric chamber 45 located at the lower side in FIG. 1. Partition wall 411 has a cylindrical communicating hole 411*a* into which the lower end of electromagnetic valve 21 is inserted. An O-ring 18 as a first sealing member air-tightly seals between electromagnetic valve 21 and communicating hole 411*a*. On the other hand, the top end of electromagnetic valve 21 is engaged with cylindrical convex portion 434. By opening and closing electromagnetic valve 21, the communication between first atmospheric chamber 44 and second atmospheric chamber 45 is connected or interrupted.

First atmospheric chamber 44 communicates with the atmosphere through an air inlet 44*a* as an air intake port disposed at the lower right side of dividing wall 41 in FIG. 1 and is separated from evaporative fuel absorbing chamber 310 with side surface 312. Activated charcoal case 31 and electromagnetic valve case 46 share side surface 312 separating evaporative fuel absorbing chamber 310 from first atmospheric chamber 44. Second atmospheric chamber 45 communicates with evaporative fuel absorbing chamber 310. Accordingly, by opening and closing electromagnetic valve 21, the communication between evaporative fuel absorbing chamber 310 and the atmosphere is connected or interrupted.

The structure of electromagnetic valve 21 is described hereinafter based on FIG. 1.

Electromagnetic valve 21 includes an electromagnetic solenoid 1, a coil supporting member 8 for supporting electromagnetic solenoid 1, and a cap 10 attached to the top portion of electromagnetic solenoid 1. A moving core 16 as a component of electromagnetic solenoid 1 connects or interrupts the communication between the first passage 10*a* formed in cap 10 and the second passage 8*a* formed in coil supporting member 8.

Cap 10, made of resin for example, includes a bowl-like portion 101 having a wide opening portion at the lower part thereof and a cylindrical portion 102 extending to the bottom portion of bowl-like portion 101. First passage 10*a* is formed inside cylindrical portion 102 into which the air flows.

Electromagnetic solenoid 1 is equipped with components for forming a magnetic path, which includes a coil 2, a yoke 3, a magnetic plate 4 and moving core 16, and supporting members including a coil supporting member 8 and a second mold member 9 for supporting coil 2 and magnetic plate 4.

Coil supporting member 8 is formed in a cylindrical bobbin and made of resin. Inside coil supporting member 8, magnetic plate 4 is insertedly-molded which has the longitudinal sectional shape of two "L"s facing back to back. An exposed portion 4*a* located at one end of magnetic plate 4 is exposed from coil supporting member 8 and is magnetically connected to yoke 3 as described below. Coil 2 wound around coil supporting member 8 generates magnetic flux which passes through magnetic plate 4 when electricity is supplied thereto. Second passage 8*a* is formed inside coil supporting member 8. O-ring 18 is fixed to the outer periphery of the lower end of coil supporting member 8 in FIG. 1. When electromagnetic valve 21 is fixed in electromagnetic valve case 46, second atmospheric chamber 45 is firmly connected to second passage 8*a* and air-tightness of evaporative fuel absorbing chamber 310 is also secured by O-ring 18.

Cylindrical second mold member 9 made of resin covers the outer periphery of coil supporting member 8 to protect the outer periphery of wound coil 2. A ring-shaped packing seal is fixed at the upper end of second mold member 9 in FIG. 1. When second mold member 9 is assembled in yoke 3 as described below, the packing seal seals the inside and the outside of second mold member 9 liquid-tightly.

Yoke 3 as one of components for forming the magnetic path has a cylindrical shape with a bottom 3*b* fixed to the wide opening portion of bowl-like portion 101 of cap 10. Center portion of bottom 3*b* is depressed downwardly, so that a space portion 12 is formed between bowl-like portion 101 of cap 10 and bottom 3*b* of yoke 3 when yoke 3 is fixed to cap 10. A communicating hole 3*a* is formed at bottom 3*b* so that the air circulating in first passage 10*a* can pass through bottom 3*b*. A filter 13 made of silicon type sponge is contained in space portion 12 to remove foreign substances entering from first passage 10*a*.

Moving core 16 as one of components for forming the magnetic path is contained in a space portion formed between coil supporting member 8 in yoke 3 and bottom portion 3*b* of yoke 3.

Moving core 16 includes a dish-like portion 16*a* which surface can contact with the inner wall of bottom 3*b* and a sliding portion 16*b* formed in a cylinder with a bottom. The sliding portion 16*b* extends from the lower part of dish-shaped portion 16*a* in FIG. 1 and can slide inside second passage 8*a*. A passage 16*d* is formed inside sliding portion 16*b*. A communicating hole 16*c* is formed at the bottom portion of sliding portion 16*b* for communicating passage 16*d* with second passage 8*a*. A compression coil spring 6, of which one end contacts the inner wall of the bottom portion of sliding portion 16*b* and the other end contacts the inner wall of the bottom 3*b* of yoke 3, applies pressure on moving core 16 toward coil supporting member 8.

A sheet rubber 17 is fixed to dish-like portion 16*a* of moving core 16, corresponding to the position of communicating hole 3*a* formed at the bottom 3*b* of yoke 3. When moving core 16 moves to bottom 3*b* of yoke 3 against the pressure applied by compression coil spring 6, sheet rubber 17 contacts with bottom portion 3*b* of yoke 3 to close communicating hole 3*a*. In other words, sheet rubber 17 as a valve member is seated at bottom portion 3*b* as a valve seat to close communicating hole 3*a*, and electromagnetic valve 21 is closed.

An operation of electromagnetic valve 21 is hereinafter described.

When electricity is not supplied to coil 2, electromagnetic valve 21 is open as shown in FIG. 1. That is, moving core 16 is pressed toward coil supporting member 8 by compression coil spring 6. Since communicating hole 3*a* of yoke 3 is open, first passage 10*a* and passage 16d inside moving core 16 communicate with each other through communicating hole 3*a*. Accordingly, first passage 10*a* opened to the atmosphere and second passage 8*a* of coil supporting member 8 opened to second atmospheric chamber 45 communicate with each other.

When electricity is supplied to coil 2, magnetic flux generated by coil 2 flows through yoke 3, magnetic plate 4, and moving core 16 as a closed magnetic path. Therefore, moving core 16 is moved to yoke 3 against the pressure applied by compression coil spring 6, thus, sheet rubber 17 is seated at bottom portion 3*b*. Accordingly, the communication between first passage 10*a* and passage 16*d* as well as between the atmosphere and evaporative fuel absorber 22 is interrupted to close electromagnetic valve 21.

Electromagnetic valve 21 is installed in electromagnetic valve case 46 according to the following procedures.

First, side cover 42 is attached to case 30, and the periphery of side cover 42 is fixed to case 30 with oscillatory deposition or the like.

Next, the lower end 8*b* of coil supporting member 8 is inserted into communicating hole 411*a* as a fixing portion disposed on partition wall 411, so that the lower end of electromagnetic valve 21 is fastened to partition wall 411 as a portion of dividing wall 41 of case 30.

Upper cover 43 is fixed to the upper opening portion of dividing wall 41 as described above. In this way, electromagnetic valve case 46 is formed and first atmospheric chamber 44 is defined. At this time, cylindrical portion 102 of cap 10 located at the top end of electromagnetic valve 21 is engaged with cylindrical convex portion 434 of upper cover 43, so that the top end of electromagnetic valve 21 is fastened to upper cover 43. Since cylindrical convex portion 434 has plural communicating holes 434*a*, communication between first atmospheric chamber 44 and first passage 10*a* is secured. By fixing upper cover 43, electromagnetic valve 21 is completely assembled in electromagnetic valve case 46.

Since the bottom portion of electromagnetic valve 21 is fastened to partition wall 411 and the top end of electromagnetic valve 21 is fastened to upper cover 43 as described above, electromagnetic valve 21 is contained in electromagnetic valve case 46 in the state that both top and bottom ends of electromagnetic valve 21 are fastened to electromagnetic valve case 46 as a part of case 30. At this time, since air inlet 44*a* disposed lower right side in FIG. 1, first passage 10*a* is located away from air inlet 44*a*.

Air flow where electromagnetic valve 2 is open is hereinafter described based on FIG. 1.

The air flowing into the lower part of first atmospheric chamber 44 from air inlet 44*a* flows between dividing wall 41 forming first atmospheric chamber 44 and electromagnetic valve 21 from the lower side to the upper side and is introduced from communicating hole 434*a* of upper cover 43 at the top portion of first atmospheric chamber 44 to first passage 10*a* of electromagnetic valve 21. Since electromagnetic valve 21 is open, the air introduced to electromagnetic valve 21 flows from first passage 10*a* to second atmospheric chamber 45 through filter 13, communicating hole 3*a*, passage 16*d*, and second passage 8*a* and is supplied to evaporative fuel absorbing chamber 310.

Since electromagnetic valve 21 is directly fixed to dividing wall 41 of case 30 according to the evaporative fuel treatment device in the first embodiment of the present invention, a pipe for connecting the electromagnetic valve to the evaporative fuel absorber is not required, thus, leakage of evaporative fuel from this pipe is prevented. In addition, the installation space for the evaporative fuel treatment device can be made smaller, and it is easy to install the device in a vehicle. Furthermore, a process for connecting the pipe to the evaporative fuel absorber can be omitted, and thereby the number of necessary parts as well as the cost can be reduced.

Upper cover 43 is fixed to the upper opening portion of dividing wall 41 by engaging hook portion 433 with the fitting hole inside dividing wall 41. As a result, upper cover 43 is fixed by only one process where snap 432 is placed along the inner side of the upper opening of dividing wall 41, thus improving working efficiency.

Since electromagnetic valve case 46 containing electromagnetic valve 21 is formed as a part of case 30 and both top and bottom ends of electromagnetic valve 21 are held between upper cover 43 of electromagnetic valve case 46 and partition wall 411 of electromagnetic valve 21 can be stably installed inside electromagnetic valve case 46. Thus, the clatter of electromagnetic valve 21 is prevented. Even if canister assembly 20 tilts or vibrates, the air-tightness inside evaporative fuel absorbing chamber 310 can be secured. Accordingly, leakage of evaporative fuel at the portion where electromagnetic valve 21 is fixed to case 30 can be reduced.

The air supplied to evaporative fuel absorber 22 circulates from the lower part to the upper part between dividing wall 41 and electromagnetic valve 21 in first atmospheric chamber 44 of electromagnetic valve case 46 and is introduced from the top end of electromagnetic valve 21 into electromagnetic valve 21. Upper cover 43 covering the top end of electromagnetic valve case 46 functions as a water guard for electromagnetic valve 21, so that water and dust from the outside cannot easily go into electromagnetic valve 21. Moving core 16 of electromagnetic valve 21 cannot be easily rusted, and further, durability of filter 13 can be improved. Since electromagnetic valve 21 is contained inside electromagnetic valve case 46 and the circumference of electromagnetic valve 21 is surrounded with upper cover 43 and dividing wall 41 except air inlet 44*a*, electromagnetic valve 21 is protected from external damage and water.

Figure 5:
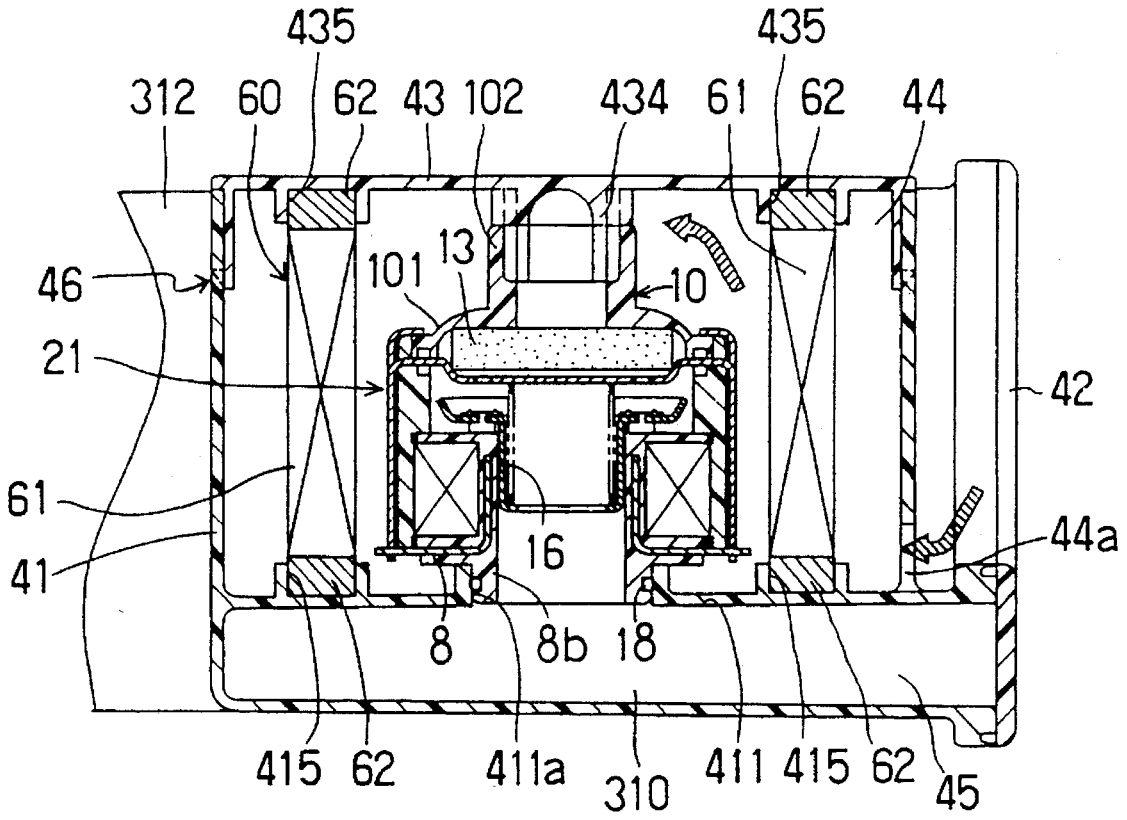
FIG. 5 is a cross-sectional view of an electromagnetic valve disposed in an evaporative fuel treatment device according to a second embodiment of the present invention.

A second embodiment of the present invention is hereinafter described with reference to FIG. 5. In the second embodiment, a filter is installed inside the first atmospheric chamber 44, which is different from the first embodiment.

A cylindrical air filter 60 includes a filter body 61 having plural folds extending in the axial direction and ring-shaped seal members 62 disposed at both ends of filter body 61. A ring-shaped engaging groove 435 is formed around cylindrical convex portion 434 in the first atmospheric chamber of upper cover 43. The other ring-shaped engaging groove 415 is formed around communicating hole 411*a* at the first atmospheric chamber side of partition wall 411. When seal members 62 are engaged with respective engaging grooves 435 and 415, air filter 60 is held between upper cover 43 and partition wall 411. Thus, the circumference of electromagnetic valve 21 is surrounded with air filter 60.

The structure of other parts is substantially same as in the first embodiment.

According to the evaporative fuel treatment device of the second embodiment of the present invention, the air flowing into first atmospheric chamber 44 from air inlet 44*a* is filtered in advance by air filter 60 having a larger area than filter 13, then, it is introduced to electromagnetic valve 21. In addition to the effect of the first embodiment, the load imposed on filter 13 of electromagnetic valve 21 can be reduced, thus making it possible to extend the durability of filter 13 and the life of electromagnetic valve 21.

In case the mesh of air filter 60 is fine enough in the second embodiment, filter 13 disposed in electromagnetic valve 21 can be omitted. In this way, it is possible to make the thickness of clearance 16 thinner, so that electromagnetic valve 21 can be made smaller in the longitudinal direction.

In the above-described first and second embodiments, the top and bottom ends of electromagnetic valve disposed at the air-releasing side of the evaporative fuel absorber are fastened inside the case, however, this method of fixing the electromagnetic valve can be applied to other electromagnetic valves such as a purge valve, an internal pressure control valve or the like.

Furthermore, case 30 and dividing wall 41 are integrally formed and upper cover 43 is fixed to the opening portion of dividing wall 41 in the above-described embodiments, however, dividing wall 41 of canister 30 can be eliminated. Instead of dividing wall 41, a covering portion extending toward the case 30 to cover the outer periphery of electromagnetic valve 21 can be integrally formed with the upper cover and the top of the covering portion can be directly fixed to case 30. In this case, a receiving chamber (first atmospheric chamber 44) for receiving electromagnetic valve 21 can be formed between the covering portion of the upper cover 43 and case 30.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. An evaporative fuel treatment device comprising:

a case having an evaporative fuel absorbing chamber for absorbing evaporative fuel, an air inlet for introducing air into said case, and a communicating portion for communicating said evaporative fuel absorbing chamber with said air inlet;

an electromagnetic valve, having a first opening portion for introducing air from said air inlet and a second opening portion disposed at said communicating portion, for opening and closing a communication between said first opening portion and said second opening portion; and a cover forming a receiving chamber for receiving said electromagnetic valve with said case in such a manner that said receiving chamber communicates with said air inlet and having a fastening portion for positioning said electromagnetic valve;

wherein said fastening portion of said cover fastens said electromagnetic valve to said case when said cover is fixed to said case.

2. An evaporative fuel treatment device according to claim 1, wherein said fastening portion of said cover is a convex portion to be engaged with said first opening portion of said electromagnetic valve.

3. An evaporative fuel treatment device according to claim 1, wherein:

said case includes a wall for defining said receiving chamber so as to surround an outer periphery of said electromagnetic valve and having an upper opening portion, and said cover is disposed so as to cover said upper opening portion of said wall.

4. An evaporative fuel treatment device according to claim 2, wherein said first opening portion and said second opening portion of said electromagnetic valve are disposed in opposition to each other.

5. An evaporative fuel treatment device according to claim 1, wherein said electromagnetic valve is firmly supported and fixed between said case and said cover.

6. An evaporative fuel treatment device according to claim 1, wherein said air inlet is provided in a position away from said first opening portion.

7. An evaporative fuel treatment device according to claim 3, wherein said air inlet is formed at an opposite side of said first opening portion.

8. An evaporative fuel treatment device according to claim 1, wherein:

said case includes a cylindrical portion at said communicating portion; and a seal member is disposed between said cylindrical portion and said second opening portion of said electromagnetic valve.

9. An evaporative fuel treatment device according to claim 1, further comprising:

a filter disposed in said receiving chamber and between said first opening portion of said electromagnetic valve and said air inlet.

10. An evaporative fuel treatment device according to claim 9, wherein:

said filter is formed in a cylindrical shape so as to surround said electromagnetic valve; and both ends of said cylindrical filter are supported between said cover and said case with a sealing member.

11. An evaporative fuel treatment device comprising:

a case having a partition wall for dividing an evaporative fuel absorbing chamber therein to absorb evaporative fuel and having an upper opening portion at one end, said partition wall having a fixing portion;

an upper cover for covering said upper opening portion of said case and having a convex portion; and an electromagnetic valve having a first opening portion fastened with said convex portion of said upper cover and a second opening portion engaged with said fixing portion of said partition wall, said electromagnetic valve being disposed in a space formed with said case and said upper cover, wherein;

said first opening portion communicates with an outside of said case, said second opening portion communicates with said evaporative fuel absorbing chamber by being engaged with said fixing portion, and said electromagnetic valve opens and closes a communication between said evaporative fuel absorbing chamber and said first opening portion.

12. An evaporative fuel treatment device according to claim 11, wherein said first opening is open to atmosphere.

13. An evaporative fuel treatment device according to claim 11, wherein;

said first opening is open to said case near said convex portion while said electromagnetic valve is disposed in said case, and air circulates from an outer side of said fixing portion through an inner side of said convex portion around said electromagnetic valve and said first opening into said electromagnetic valve.

14. An evaporative fuel treatment device according to claim 13, wherein a filter for filtering said air flowing into said electromagnetic valve is disposed inside said case.

15. An evaporative fuel treatment device comprising:

a case having an air inlet for introducing air thereinto and an air outlet for introducing air to an evaporative fuel absorbing chamber for absorbing evaporative fuel therefrom, said case having an opening portion;

a valve case disposed in said case for forming a receiving chamber, said valve case including an air passage for communicating between said air inlet and said air outlet therein;

a valve assembly disposed in said receiving chamber for opening and closing said air passage; and a cover fixed to said opening portion and having a supporting portion for fixedly supporting said valve assembly within said case with said valve case.

16. An evaporative fuel absorbing chamber according to claim 15, wherein said valve assembly includes therein a filter for filtering air supplied to said valve assembly.

17. An evaporative fuel absorbing chamber according to claim 15, wherein;

said valve assembly is vertically disposed within said case, and said air inlet is formed on a side surface of said case.

18. An evaporative fuel absorbing chamber according to claim 17, wherein;

said opening portion is formed on a top surface of said case; and said valve assembly is inserted from said opening portion.

19. An evaporative fuel absorbing chamber according to claim 17, wherein said air outlet is open at a bottom surface of said case.

20. An evaporative fuel absorbing chamber according to claim 19, wherein an upstream end of said air passage is open at an upper side and a downstream end is open at a down side.

* * * * *